United States Patent [19]

Glaser

[11] 4,395,244

[45] Jul. 26, 1983

[54] METHOD OF MAKING A DISPLAY PANEL

[76] Inventor: David Glaser, 1112 NE. 23rd Dr., Wilton Manors, Fla. 33305

[21] Appl. No.: 253,993

[22] Filed: Apr. 13, 1981

Related U.S. Application Data

[62] Division of Ser. No. 51,152, Jun. 22, 1979, Pat. No. 4,303,847.

[51] Int. Cl.[3] ..... H01J 9/36; H01J 9/385

[52] U.S. Cl. ..... 445/25; 156/286

[58] Field of Search ..... 29/25.13, 25.16; 316/19; 156/286

[56] References Cited

U.S. PATENT DOCUMENTS

| | | | |
|---|---|---|---|
| 3,701,193 | 10/1972 | Ragland | 29/25.13 X |
| 3,807,833 | 4/1974 | Graham et al. | 29/25.13 X |
| 3,811,060 | 5/1974 | Tsujimoto | 313/220 X |
| 3,947,713 | 3/1976 | Prybyleh | 313/174 |
| 4,067,764 | 1/1978 | Walker et al. | 156/286 X |
| 4,139,250 | 2/1979 | Jacobs et al. | 316/19 |
| 4,159,921 | 7/1979 | Inohara et al. | 156/286 X |

*Primary Examiner*—Kenneth J. Ramsey

*Attorney, Agent, or Firm*—Edmond T. Patnaude

[57] ABSTRACT

A method of making a display panel comprising a transparent rigid substrate and an electrode structure held against the rigid substrate by means of a flexible backing comprises the steps of sandwiching the electrode structure between the transparent rigid substrate and flexible backing, sealing the backing to the substrate and evacuating the atmosphere from the sealed sandwich structure. The atmospheric air pressure causes the flexible backing to uniformly press the electrode structure against the transparent rigid substrate. A suitable gas atmosphere and getter device is also disclosed.

7 Claims, 13 Drawing Figures

METHOD OF MAKING A DISPLAY PANEL

This is a division of application Ser. No. 06/051,152, filed June 22, 1979, now U.S. Pat. No. 4,303,847.

BACKGROUND OF THE INVENTION

Various types of the so-called flat-panel displays are well known in the art and include, for example, plasma discharge panels, cathodoluminescent panels, electroluminescent panels, liquid-crystal panels, electrophoretic panels and electrochromic panels. Although these flat-panel display systems are substantially different from one another in construction and method of operation, they have in the past all been contained in substantially similar structural packages, namely the electrode structure is sandwiched between a pair of glass panels or between one glass panel and a rigid rear cover member. While the basic panel construction is suitable for use with relatively small panels, when larger panels of, for example, ten to one hundred square feet are required, the weight, cost and stresses in the panels make such construction impractical.

Of the above-mentioned types of displays, the plasma discharge and cathodoluminescent types require a very-low-pressure, controlled atmosphere wherefor the space or cavity within the panel must be sealed from the atmosphere and evacuated. When this cavity between the front and rear panels of a prior art flat-panel display is evacuated, the central areas of the panels are pressed by atmospheric pressure into the cavity, which causes high tensile stresses to be established within the panels. As a consequence, since at least one of the panels must be glass and thus low in tensil strength, large displays cannot be made in this way unless inordinately thick glass panels are used.

SUMMARY OF THE INVENTION

Briefly, there is provided in accordance with the teachings of the present invention a new and improved method of constructing flat-panel displays as well as a new and improved flat-panel display. The invention may be used with any of the heretofore mentioned types of displays which employ a transparent glass sheet as the front face of the panel and through which the displayed image is observed.

As described in greater detail hereinafter, a display panel embodying this invention utilizes a front glass sheet or pane, a substantially compliant or conformable electrode structure positioned against the rear face of the glass pane, and a thin, substantially impervious, malleable rear sheet which covers the rear side of the electrode structure and is hermetically sealed to a peripheral portion of the front glass pane surrounding the elastrode assembly. Evacuation of the space between the rear sheet and the glass pane causes the rear sheet to be drawn against the rear surfaces of the electrode structure to seal the space within the electrode structure from the ambient without exerting any substantial tensile, sheer or compressive forces on the glass pane. Moreover, the electrode structure need not be mechanically attached to the glass pane inasmuch as it is held in place against the pane by the differential pressure across the rear sheet, although certain portions of the structure, and even the entire structure, may if desired be sealed or fused to the front panel.

Where large panels are required, it is necessary that the electrode structure be conformable to the rear face of the glass pane.

Flat-panel displays characteristically have had a high ratio of operative to overall internal space which has made it extremely difficult to maintain the proper gaseous atmosphere for appreciable periods of time because of gas imbedment in the cathodes and outgasing of the internal parts of the panel. In accordance with an important feature of this invention a porous mat or blanket may be positioned between the electrode structure and the rear sheet, and this blanket provides a relatively large space within the panel which functions as a gas reservoir. When used in combination with a continuously operating getter or sputter pump, the necessary low-pressure gaseous atmosphere can be maintained within the panel for extended periods of time.

Preferably, the porous mat or blanket completely overlies the rear side of the electrode structure to protect the rear sheet from any sharp edges or irregularities on the electrode structure and to provide uniform support to the rear sheet. If the rear sheet is formed of metal, then the blanket is preferably formed of a good insulating material. However, if desired, the rear sheet may constitute one electrode of the electrode structure in the panel; in this case the blanket is apertured or omitted.

As thus far described it may be seen that the front glass pane is the primary support member in the panel. The seals between the rear sheet and the glass pane are not support members nor are any substantial stresses exerted on these seals during either the manufacture or use of the panel. If desired, the rear of the panel can be enclosed in a protective cover which may, for example, be a polyurethane material foamed directly over the rear of the panel so as to precisely conform thereto.

After the parts of the panel have been assembled, the flat-panel display may be evacuated in the conventional manner by maintaining the panel at a relatively high temperature while it is connected to a vacuum pump, or it may be evacuated and sealed while in a vacuum oven. However, both of these procedures becomes difficult and expensive to carry out when large panels are to be fabricated. In accordance with another aspect of the present invention the panel may be evacuated and sealed at relatively low temperatures such as, for example, room temperature. In this case, after the rear sheet has been sealed to the glass pane the cavity within the panel is evacuated by means of a vacuum pump to a pressure of say $10^{-2}$ to $10^{-4}$ Torr, the cavity is then back-filled with the gas required by the particular type of display system used, and the cavity within the panel is then sealed from the atmosphere. Usually, the gas fill will comprise inert gases, such as neon or argon. After the cavity in the panel has been sealed off, the atmosphere within the panel is substantially below atmospheric pressure but contains an excessive amount of reactive gases including water vapor, and the panel structure contains sorbed water vapor.

In order to remove the reactive gases from the cavity within the panel one or more sputter pumps or active getters which were previously mounted within the cavity are then made operative to remove these reactive gases from the atmosphere within the panel.

GENERAL DESCRIPTION OF THE DRAWINGS

The present invention will be better understood by a reading of the following detailed description taken in connection with the accompanying drawings wherein.

DETAILED DESCRIPTION OF THE INVENTION

Figure 1:
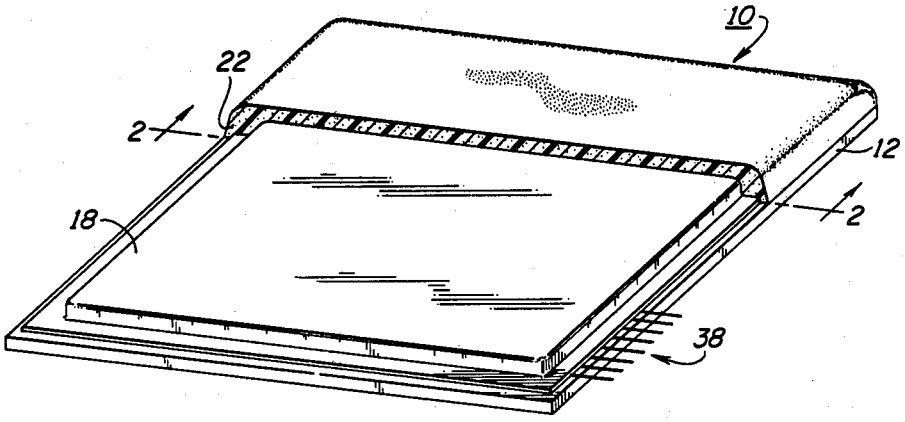
FIG. 1 is a perspective view, partly broken away, taken from the rear of a flat-panel display embodying the present invention.
Figure 2:
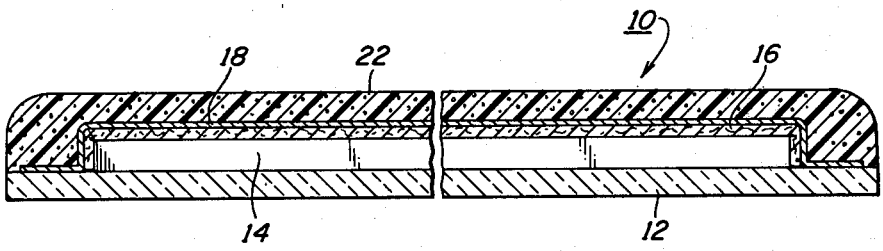
FIG. 2 is a fragmentary, cross-sectional view taken along the line 2—2 of FIG. 1.

Referring to FIGS. 1 and 2 of the drawings, a flat-panel display 10 comprises a transparent sheet or pane 12 preferably formed of glass and having a central window area behind which an electrode structure 14 is located. This invention is not limited to any particular electrode structure nor to its method of operation. However, by way of example only, the electrode structure 14 may be of a relatively simple type such as disclosed in copending application Ser. No. 232,972, filed Feb. 9, 1981. A compressible porous sheet, mat or blanket 16 is draped over the rear side of the electrode structure 14, and a thin malleable, impervious sheet 18 overlies the blanket 16 and is hermetically sealed to the glass pane 12 throughout a continuous area surrounding the electrode structure. The glass pane 12 and the sheet 18 thus define an enclosed cavity in which the electrode structure is mounted. The pressure within this cavity is maintained below atmospheric pressure whereby the sheet 18, which is formed of a soft malleable material, is drawn tightly against the rear side of the blanket to hold the electrode structure 14 tightly against the rear face of the glass pane 12. The malleability of the sheet 18 enables it to conform to the shape of the blanket 16 and underlying electrode structure so that no high stresses are established in the glass pane.

Where, however, the panels involved have large display areas, it is necessary to provide means for preventing the electrode structure itself from establishing undue stresses in the glass pane as the electrode structure is pressed against the pane by the pressure differential across the sheet 18. To this end, the electrode structure itself must be segmented or otherwise made compliant to permit its front surfaces substantially to conform to the rear face of the glass pane 12 as the electrode structure is pressed against the glass pane.

The electrode structure may simply rest on the viewing glass pane 12 and be held there by atmospheric pressure against the outside sheet 18. Alternately, some or all of the electrode structure may be sealed or molded to the pane, or may be fabricated by depositing thick or thin films of conductors or insulators onto the pane. It is only necessary that any voids or gaps in the electrode and other internal structure of the panel be relatively small, so that atmospheric pressure from sheet 18 is transmitted to substantially all of the rear surface of pane 12.

The blanket 16 may perform three spearate functions in the panel. One, it protects the rear sheet from damage when that sheet is pressed toward the electrode structure. Two, it insulates the electrode structure from the rear sheet. Three, it provides a gas reservoir of relatively large volume within the panel. Where, however, all of these functions are not required, the blanket 16 can be omitted. If, for example, the rear side of the electrode structure 14 has no sharp irregularities or voids which might puncture the sheet 18 or cause the sheet to draw inwards excessively when a vacuum is drawn in the cavity, the blanket is not needed to protect the sheet 18. Moreover, if the additional open reservoir space within the panel is also not needed, then the blanket 16 can be omitted. If the sheet 18 is not conductive or if it is conductive and an active electrode, this blanket 16 may be omitted.

The rear sheet 18 must be substantially impervious to gas, it must be compliant, and it must not deteriorate under the normal conditions encountered by a panel display. It may be transparent, or it may be opaque. I have found, however, that metal foil is well suited for use as the sheet 18, with aluminum, copper or nickel foil having a thickness of one to five mils. being especially satisfactory since these are easily sealed to the glass pane and are readily available.

Inasmuch as the sheet 18 is relatively fragile in that it is soft and thus easily punctured, for most applications it will be necessary to enclose the rear of the sheet with a protective cover. FIGS. 1 and 2 illustrate a protective cover in the nature of a resilient foam member 22 which may be foamed in place over the rear side of the sheet 18 so as to conform to the surface of the sheet 18, or the cover can be molded separately and suitably secured to the remainder of the panel. The use of a plastic foam cover 22 has the advantage that it adds very little weight to the panel and causes no stresses in the glass pane 12. It will be apparent, however, that many other types of protective covers can be provided to protect the sheet 18 and thus to facilitate handling and mounting of the panel display.

Although the present invention is not limited to any particular technique by which the sheet 18 is heremtically sealed to the glass pane 12, several different sealing configurations are illustrated in FIGS. 3–7.

Figure 3:
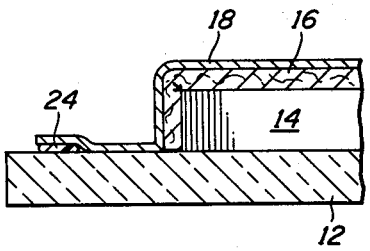
FIG. 3 is a cross-sectional view showing one way of sealing a rear sheet to the front glass pane.

Referring to FIG. 3, the seal is provided between the peripheral portion of the sheet 18 and the rear face of the glass pane 12. Where the sheet 18 is metal foil, it is preferable to use a bead 24 of vitreous frit or solder glass, which when fired in the conventional manner, provides a hermetic seal between the mutually engaged areas of the metal foil and the glass pane. However, as in the other embodiments of the invention described hereinafter, the seal may be formed of a devitrifying frit or of any other suitable sealant including an organic or a metal seal.

Figure 4:
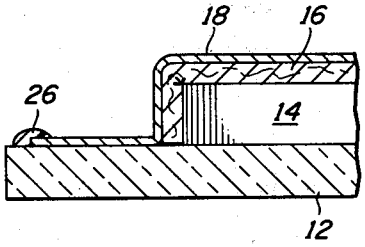
FIGS. 4, 5, 6 and 7 are views similar to that of FIG. 3, but showing other ways of sealing the rear sheet to the front glass pane.
Figure 5:
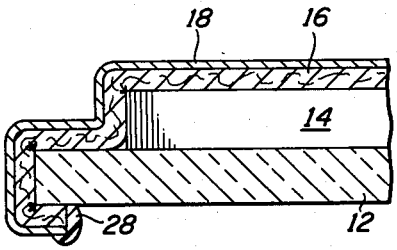

In the embodiment of the invention shown in FIG. 4, the seal is effected by a frit bead or other seal 26 which overlies the edge of the sheet 18. In the embodiment of FIG. 5 the sheet 18 extends around the side edges of the glass pane 12 and is sealed to the front face of the pane by a frit bead 28 which overlies the edge of the sheet 18. It will be noted that the blanket 16 also extends over the side edges of the pane 12 to protect the sheet 18 from damage by any sharp irregularities along the edges of the pane.

Figure 6:
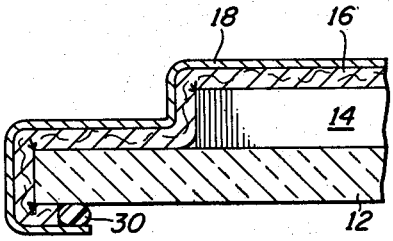
Figure 7:
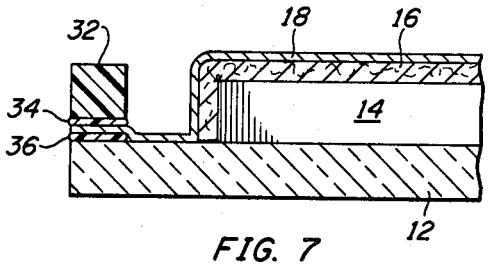

The embodiment of FIG. 6 is similar to that of FIG. 5 except that the sheet 18 extends a short distance beyond the corresponding edge of the blanket 16 and is sealed to the front face of the pane 12 by a frit bead or other seal 30 positioned at the edge of the blanket 16 between the sheet 18 and the front face of the pane 12. The embodiment of FIG. 7 is similar to that of FIG. 3 except that a bar 32, preferably cut from the same plate of glass as the pane 12 so as to have closely similar characteristics of thermal expansion, overlies at least one edge portion of the sheet 18. Glass frit beads 34 and 36 are respectively interposed between the bar 32 and the foil 18 and between the foil 18 and the glass pane 12.

In all of the above-described sealing arrangements the seal is effected by glass frit, which may be either vitreous or devitrifying. However, other sealants such as solder or other materials may be used. One of the important advantages of the conjunction of the malleable metal back and the glass front is the substantial relaxation of the requirement for matching the coefficients or thermal expansion of the metal and the glass, since the thin, soft and malleable sheet will comply to thermally induced stress by deforming, without causing significant stress or cracking in the glass.

The electrode structure 14 may be any of the many types of self-supporting display devices which are adapted to be viewed through the central window area of the glass pane 12 and which operate at a pressure level substantially below atmospheric pressure. Such displays are generally powered and controlled by external circuitry which must be connected to the electrode structure by a plurality of conductors such, for example, as the conductors 38 shown in FIG. 1. The conductors 38 extend out from between the glass pane 12 and the rear sheet 18. These conductors are connected at their inner ends to various terminals on the electrode structure.

Figure 8:
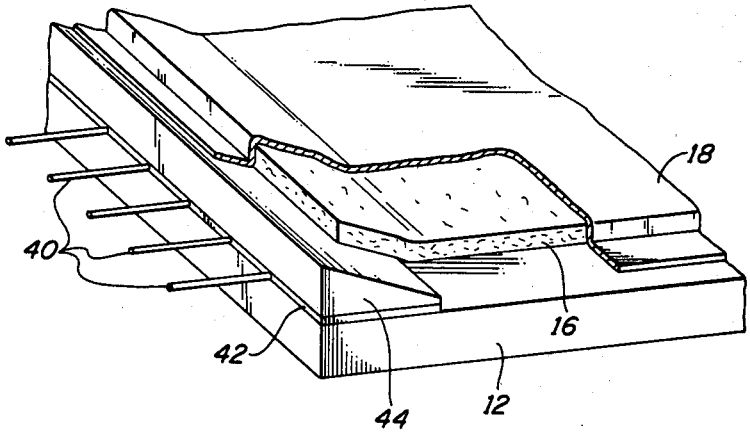
FIG. 8 is a perspective view of a portion of a flat panel display showing one method of making external electrical connections to the electrode structure within the panel.

Various techniques may be used to connect the electrode structure to the associated external circuitry while maintaining the integrity of the seal. As shown in FIG. 8, a plurality of wires 40, which are suitably connected to the electrode structure within the panel, lie along the rear face of the glass pane 12 and extend outwardly beyond a side edge thereof. A layer of frit 42 thicker than the wires is spread over and between the wires, and a tapered glass bar 44, which is preferably cut from the same plate of glass from which the pane 12 was cut, is positioned over the frit layer and sealed thereto. The blanket 16 rides smoothly up over the top of tapered bar 44, and sheet 18 is brought down over the edges of the blanket and sealed to the surface of bar 44 and pane 12. The use of the tapered bar 44 avoids formation of a step or notch in blanket 16 or sheet 18.

Figure 9:
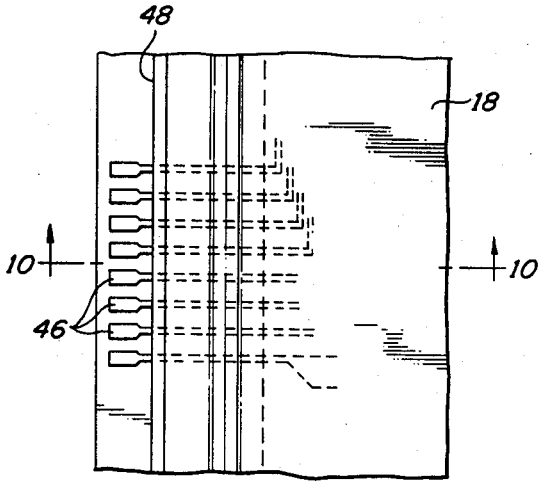
FIG. 9 is a top plan view of a portion of a flat panel display.
Figure 10:
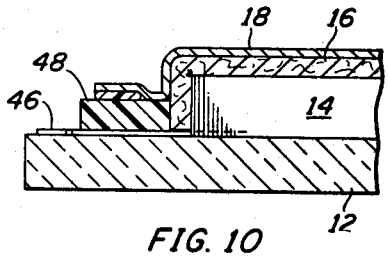
FIG. 10 is a fragmentary cross-sectional view taken along the line 10—10 in FIG. 9.

FIGS. 9 and 10 illustrate another technique for making electrical connections between the electrode structure and the external circuitry. As there shown, a plurality of parallel conductors 46 are printed on the rear surface of the glass pane 12 near one edge thereof and a glass bar 48 is sealed against the conductors and the adjacent portions of the glass pane and thus becomes an integral part of the pane. The rear sheet 18 is in turn sealed to the rear face of the bar, and of course, to the ends thereof. The conductors 46 may be connected at their respective inner ends to the electrode structure. Preferably, however, the conductors 46 are integral portions of the electrodes which are themselves screened or printed on the rear face of the pane 12 in accordance with well known printed circuit technology.

After a panel display has been assembled and the rear sheet 18 has been sealed to the glass pane 12, it is necessary to pump the gas out of the cavity within the panel. For this purpose a tubulation extends into the cavity to provide the conduit through which the gas is exhausted from the panel. After the desired atmosphere has been provided within the panel the tubulation is sealed off so that the desired internal atmosphere may be maintained thereafter.

Figure 11:
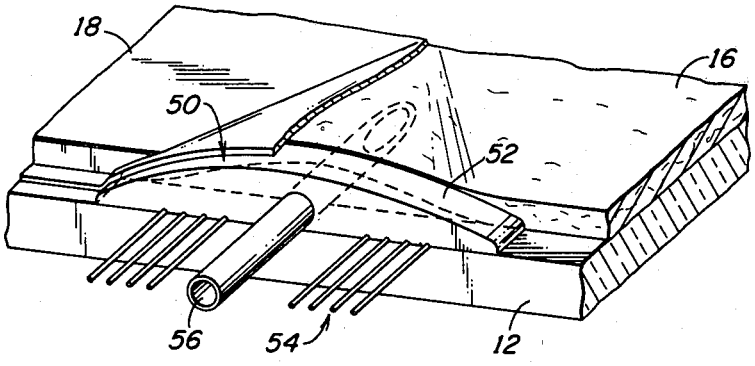
FIG. 11 is a perspective view illustrating another way of making external electrical connections to the electrode structure and for mounting a tubulation thereto.

Referring to FIG. 11, there is shown a tubulation assembly 50 sealably mounted between the rear face of the glass pane 12 and the rear sheet 18. The assembly 50 includes a glass piece 52 which is sealed to the rear face of the pane 12 over a plurality of conductors 54 whose inner ends are adapted to be connected to the electrode structure (not shown in FIG. 11) located behind the window area of the pane 12. A tube 56 extends through a complementary cylindrical hole in the piece 52 and is hermetically sealed thereto. Preferably, the piece 52 and tube 56 constitute a pre-assembled unit. The rear sheet 18 extends over the piece 52 and is suitably sealed thereto to provide a hermetic seal between the sheet 18 and the pane 12. If the panel includes a blanket 16, the inner end of the tube may conveniently be positioned between the blanket 16 and the sheet 18.

Figure 12:
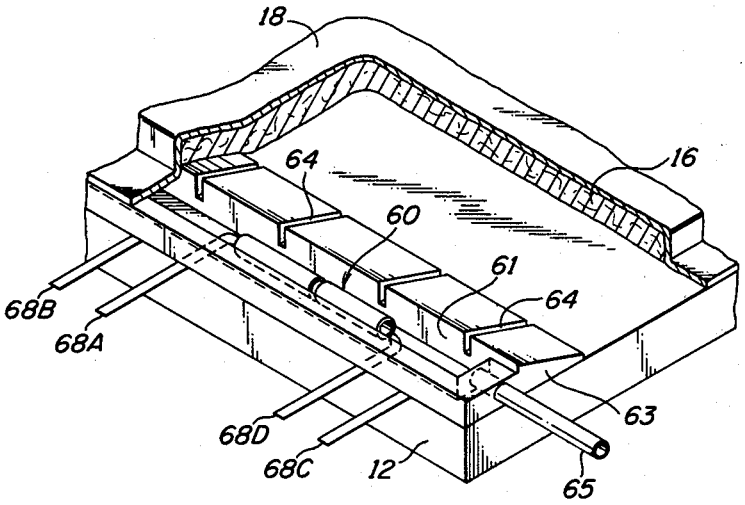
FIG. 12 is a perspective view of a combined getter and tubulation assembly which finds use in display panels embodying the present invention.

Referring to FIG. 12, there is shown a portion of a display panel which incorporates an active getter 60. A tapered piece of glass or similar material, 63, is sealably mounted to the rear face of the glass pane 12 over a plurality of ribbon-like conductors 68A, 68B, 68C and 68D. A tube 64 extends through glass piece 63 to an inner groove 61, which communicates with the interior of the display panel through a multiplicity of grooves 64. Blanket 16 rests on top of the electrode structure of the panel and smoothly upon the rear of tapered piece 63 (the top of the piece in FIG. 12), and sealing sheet 18 rests on top of blanket 16. Sheet 18 may be sealed either to the top or the side of tapered piece 63. The panel is evacuated through tubulation 64, which is sealed off after the panel has been pumped and then backfilled. Active getter 60 is then activated. For greater efficiency, the panel may be installed with the long axis of getter 60 vertical. The gas in the getter volume is heated by the action of the getter, expands, and rises in groove 61, eventually moving into the volume of the panel through connecting grooves 64 near the top of groove 61. It is replaced by cooler gas from the volume of the panel through connecting grooves 64 at the bottom of groove 61. Thus the gas in the panel is continually circulated through the getter 60 and cleansed by its action.

The getter 60 may be a conventional titanium sublimation pump comprising a pair of spaced-apart titanium tubes mounted in longitudinal alignment. One of the tubes functions as an anode and the other functions as a cathode. The getter 60 is connected to the conductors 68A and 68D, and when energized by a source of DC voltage connected across the conductors 68A and 68D, removes the reactive gas molecules from the cavity within the panel. This getter 60 when operated throughout the life of the panel in combination with the gas reservoir within the blanket 16 maintains the desired atmosphere within the electrode structure 14 irrespective of outgasing from the internal surfaces of the panel or from minor leakage of gas from the atmosphere into the panel.

Figure 13:
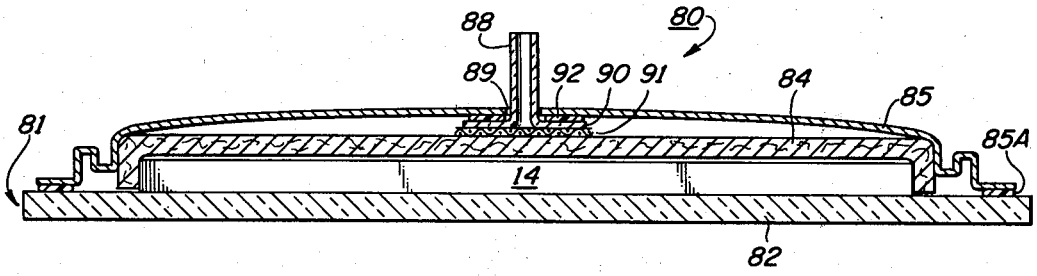
FIG. 13 is a cross-sectional view of a partially completed flat-panel display and is useful in understanding another embodiment of the present invention.

Referring to FIG. 13, a partially fabricated flatpanel display 80 comprises a transparent panel 81 which may be formed of glass and which has a central window or viewing area 82 above which is located the electrode structure 14. The electrode structure 14 rests on the panel 81 and a porous blanket 84, which is preformed to the cross-sectional shape illustrated, is positioned over the electrode structure. Preferably the blanket 84 is a mat of aluminum oxide or glass fibers. Positioned over the blanket 84 is a rear sheet 85 which is preformed to fit over the blanket 84. The sheet 85 is formed of an impervious malleable material such as metal foil and has a peripheral flange portion 85A which rests on a bead 86 of solder glass frit or other sealant.

A tubulation 88 extends through a hole 89 in the sheet 85 and includes an annular flange 90. A mesh filter 91 extends over the inner end of the tubulation to prevent fibrous pieces of blanket from entering the tubulation while the panel is being evacuated. A continuous bead 92 of solder-glass frit or other sealant is positioned between the flange 90 and the sheet 85. The use of preformed blankets and rear sheets facilitates assembly of the panels, and improves the appearance of the panel after the rear sheet has been sucked down over the blanket and the electrode structure. The rear sheet may have bellows-like corrugations formed along its periphery to accommodate differential expansion of the sheet and the rest of the structure even beyond the capability given by the malleability of the sheet.

METHOD OF MANUFACTURE

In order to manufacture a flat-panel display in accord with the teachings of this invention, the glass pane or other panel 12 is supported in a horizontal position as shown, for example, in FIGS. 1 and 2. The electrode structure 14 is then placed on the rear face of the glass pane over the window area. Electrical conductors connected to the electrode structure are then assembled onto the glass pane or connected to conductors previously printed on the pane as shown, for example, in FIG. 10. A suitable tubulation such as that shown in FIG. 11 is then mounted to the rear of the pane 12 along one edge thereof. A blanket 16 is then placed over the rear of the electrode assembly 14 and the sheet 18 is placed over the blanket. If the sealant used is solder-glass, then a bead of such solder glass is placed between the tubulation and the glass pane 12 and between the sheet 18 and opposite portions of the panel to be sealed thereto. Suitable weighting is placed over the portions of the sheet 18 to be sealed to the pane by the solder-glass so that when the panel is later cooled to room temperature the frit solidifies to seal the cavity within the panel from the atmosphere except for the passage through the tubulation. While the pane 12 remains in the horizontal position with the electrode structure resting thereon, a vacuum pump is connected to the tubulation to exhaust gas from the panel whereby the sheet 18 is forced by atmospheric pressure toward the pane 12 to hold the electrode structure 14 firmly against the rear face of the pane 12. Thereafter, the desired atmosphere in the panel can be established in any of the well-known ways so long as the pressure within the panel remains below atmospheric pressure. The channel through the tubulation is then sealed closed to complete the assembly. Thereafter the pane 12 may be positioned in an upright position and the electrode structure is held in proper registration with the window in the pane 12 by the differential pressure across the sheet 18.

An important feature of a display panel constructed in accordance with this invention is the fact that the panel can be easily disassembled for repair by simply tearing away the rear sheet 18 and removing the blanket 16 to expose the electrode structure 14.

In accordance with a preferred method for fabricating a panel embodying the invention, the temperature of the panel is not high while the reactive gases are being pumped from the panel and the panel is backfilled. Ordinarily the gas is pumped from the panel until such operation becomes inefficient because the viscous flow of the gas terminates due to the lowered pressure. Hence, the gas may be pumped out of the panel by means of a vacuum pump until a pressure of between $10^{-2}$ and $10^{-4}$ Torr is reached. At this point in the operation a considerable amount of water vapor and other reactive gases remain within the panel, primarily adsorbed onto glass surfaces. The cavity is then backfilled with the desired operating inert gas. This operating gas may be neon, helium, or other noble gas or a mixture of gases. The pressure in the cavity is increased during backfilling to say 0.5 to 100 Torr, which is well below atmospheric pressure, whereby the electrode structure is held in registration with the window area of the pane. The tubulation is then sealed closed.

In order to remove the active gases which are contained in the gas within the panel as well as those which will be released from the internal parts of the panel as the pressure in the cavity is reduced, the getter is operated. The ionization of the noble operating gas facilitates the operation of the getter in removing the active gases from the panel. The getter is operated until the partial pressures of the reactive gases have been reduced to an acceptable level, which may be, for example, about $10^{-5}$ Torr. The panel may be raised to an elevated temperature after it has been sealed and during this gettering operation to facilitate the outgasing of internal parts, and the active getter may be run at a substantially higher current than normal to facilitate cleanup of active gases.

After this cleanup or gettering process the panel is operative. It will be understood, however, that additional getters may be incorporated within the panel for later use when desired, or the getter may be operated continuously during operation of the panel.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A method of manufacturing a display panel, comprising the steps of positioning an electrode structure against one face of a rigid, glass pane having a window area, positioning a substantially impervious, flexible sheet over said electrode structure, sealing said sheet to said pane along a continuous area surrounding said electrode structure, and reducing the pressure in the space between said sheet and said pane in which said electrode structure is located below the pressure on the external side of said sheet to press said electrode structure against said pane.

2. A method according to claim 1, comprising the additional step of covering the exposed surface of said flexible sheet with a protective cover.

3. A method according to claim 2, wherein the step of covering comprises potting the exposed surface of said flexible sheet in expanded plastic foam.

4. A method according to claim 1, wherein said electrode structure is a self-standing assemblage, comprising assembling said electrode structure prior to the step of positioning said structure against said pane.

5. A method according to claim 1, comprising the additional step of positioning a compressible blanket between said electrode structure and said flexible sheet prior to said step of sealing said flexible sheet to said pane.

6. A method of manufacturing a flat-panel display, comprising the steps of positioning an electrode structure against one face of a rigid panel over a window area in said panel, positioning a getter rearwardly of said panel, positioning a melleable, gas-impervious metal foil sheet over said getter and said electrode structure sealing said sheet to said panel throughout a continuous area surrounding said electrode structure and said getter, pumping gas out of the space between said panel and said fail sheet, backfilling said space with one or more noble gases while maintaining the pressure in said space below atmospheric pressure, and then operating said getter to remove reactive gases from said space and to further reduce the pressure therein.

7. A method of manufacturing a flat-panel display, comprising the steps of positioning an electrode structure against one face of a rigid panel over a window area in said panel, positioning a porous, compressible blanket over said electrode structure, positioning a getter rearwardly of said panel, positioning a malleable, gas-impervious metal foil sheet over said blanket and said getter and said electrode structure, sealing said sheet to said panel throughout a continuous area surrounding said electrode structure and said getter, pumping gas out of the space between said panel and said fail sheet, backfilling said space with one or more nobel gases while maintaining the pressure in said space below atmospheric pressure, and then operating said getter to remove reactive gases from said space and to further reduce the pressure therein.

* * * * *

UNITED STATES PATENT AND TRADEMARK OFFICE

CERTIFICATE OF CORRECTION

PATENT NO. : 4,395,244

DATED : July 26, 1983

INVENTOR(S) : David Glaser

It is certified that error appears in the above—identified patent and that said Letters Patent is hereby corrected as shown below:

Column 1, line 57, "elastrode" should be -electrode-.

Column 2, line 44, "becomes" should be -become-.

Column 10, line 7, "fail" should be -foil-;

line 28, "fail" should be -foil-.

Signed and Sealed this

Fourth Day of October 1983

[SEAL]

*Attest:*

GERALD J. MOSSINGHOFF

*Attesting Officer*

*Commissioner of Patents and Trademarks*